United States Patent [19]

Baird

[11] 4,336,662

[45] Jun. 29, 1982

[54] APPARATUS FOR COLLECTING AND RAISING MATERIALS FROM THE OCEAN FLOOR

[76] Inventor: Dennis L. Baird, 4315 W. 182nd St., No. 334, Torrance, Calif. 90504

[21] Appl. No.: 170,633

[22] Filed: Jul. 21, 1980

[51] Int. Cl.[3] ..... E02F 3/00

[52] U.S. Cl. ..... 37/54; 37/DIG. 8

[58] Field of Search ..... 37/DIG. 8, 54, 58, 56, 37/195; 406/49, 46, 197, 198; 114/50, 44

[56] References Cited

U.S. PATENT DOCUMENTS

| | | | |
|---|---|---|---|
| 1,772,709 | 8/1930 | Culbertson | 114/50 |
| 2,844,116 | 7/1958 | Potter | 114/50 |
| 2,857,873 | 10/1958 | Norelli et al. | 114/50 |
| 3,605,671 | 10/1972 | Helbig | 114/50 |
| 3,695,203 | 10/1972 | Helbig | 114/50 |
| 3,804,046 | 4/1974 | Kruger | 114/50 |
| 3,827,383 | 8/1974 | Winer et al. | 114/50 |
| 3,855,803 | 12/1974 | Lacroix | 61/46.5 |
| 4,010,560 | 3/1977 | Diggs | 37/DIG. 8 |
| 4,155,491 | 5/1979 | Istoshin et al. | 37/DIG. 8 |
| 4,257,723 | 3/1981 | Kwee | 37/DIG. 8 |
| 4,280,288 | 7/1981 | Corfa et al. | 37/54 |

*Primary Examiner*—Clifford D. Crowder

*Attorney, Agent, or Firm*—Fulwider, Patton, Rieber, Lee & Utecht

[57] ABSTRACT

An apparatus and a related method for deep sea mining utilizing an underwater collection device for gathering material from the ocean floor, containers with a repository for holding gathered material and with a convex lid for receiving a buoyant body, means for depositing the gathered material into the containers, buoyant bodies for lifting the containers to the ocean surface, and a disposable receptacle composed of a dense material for delivering the buoyant bodies to the ocean floor. The apparatus also utilizes a disposable rack to deliver the containers to the ocean floor and dispense them. Cables guide the descent of the receptacle and container rack, and the ascent of the loaded containers. In one embodiment, the buoyant bodies are hollow, ceramic spheres filled with a gaseous substance, and the receptacle is tubular in shape. In alternative embodiments, the bodies are spheres composed of a solid, buoyant material or comprised of a rigidly reinforced envelope containing a plurality of buoyant objects. An endless belt conveyor carries the containers from the rack to a position for loading with gathered material and then to a position adjacent the receptacle where a turnstile transfers a buoyant body into the lid of a container.

48 Claims, 13 Drawing Figures

APPARATUS FOR COLLECTING AND RAISING MATERIALS FROM THE OCEAN FLOOR

BACKGROUND OF THE INVENTION

The present invention relates generally to marine mining and, more particularly, to an apparatus and method for the delivery, loading and retrieval of containers used in raising materials, such as mineral nodules, from the ocean floor.

It has been known for many years that vast amounts of minerals are present in the oceans of the world, particularly in mineral-rich nodules found on the ocean floor. Such nodules contain significant quantities of valuable nickel, copper, cobalt, manganese and other components.

In recent years, attempts have been made to mine or harvest these mineral-rich nodules, however, because the nodules are found at depths which sometimes exceed 12,000 feet below sea-level and because of the severeness of the ocean environment, many difficulties have been encountered which have made the mining technically and economically impractical, and sometimes impossible. The motion of the sea and wind must be contended with, especially during storm situations; equipment must be remotely controlled from a great distance; the nodules, which are distributed over the expansive ocean floor, must be located and collected; and failed equipment located in the ocean or on the ocean floor must be repaired or replaced. One particularly difficult problem encountered is in raising the nodules to the surface for recovery by a surface ship once the nodules have been collected.

One technique which has been tested utilized a continuous-loop bucket dredge strung between a surface ship and a nodule collection vehicle on the ocean floor. The dredge comprised a long loop of cable having scoops spaced along its length. The scoops picked up sediment containing the nodules from the sea-bed, carried their contents to the ship for dumping, and returned to the ocean floor to repeat the process. One disadvantage of this technique is the susceptibility of the cable to breakage, which results in delayed operations and loss of expensive dredge equipment.

Another technique tested utilized a pipe extending between a surface ship and the ocean floor with pumps used to bring the nodules to the surface. One such system is described in U.S. Pat. No. 3,908,290. This type of system requires an extremely long length of piping, and massive air-injection or hydraulic pumps.

One more technique to raise gathered nodules from the ocean floor is described in U.S. Pat. No. 3,314,174. The nodules are loaded in a container and the container is raised to the surface by a hoist located on a surface ship. When the container is emptied, it is returned to the ocean floor for refilling.

Yet another technique is described in U.S. Pat. No. 4,010,560 and involves use of an inflatable bag or balloon to lift a crate filled with nodules to the surface. The weight of the crate carries it to a nodule collection vehicle on the ocean floor, guided by cables extending between a surface ship and the collection vehicle. After being filled to a predetermined level, the crate is released from the cables and ejected from the collection vehicle. The lifting bag attached to the crate is then inflated to carry the crate to the surface.

Such an independent lifting technique overcomes many of the inherent technical problems which are believed to make operation of the previously mentioned techniques at great depths impractical. One disadvantage, however, of using an inflatable lifting bag is that the bags must be inflated while in water as much as 12,000 feet deep. The pressure at such a depth is approximately 7,000 pounds per square inch, and, of course, any source of air or other gaseous substance used to inflate the bag would have to be capable of generating gaseous pressure greater than that of the surrounding environment. Not only would a source of very high pressure have to be used, the flow rate of the source would have to be sufficient to minimize the time delay that occurs after a crate is ejected and before the bag is inflated enough to begin ascent.

Furthermore, the inflatable lifting bag technique requires the bag be provided with a pressure relief valve to keep the differential pressure between the interior of the bag and the surrounding environment within a tolerable limit as it ascends to permit buoyancy, but prevent rupture. The crate must also be equipped with a suitable sonar or other device to facilitate its location and recovery once it reaches the surface. Currents and the travel of the surface ship during the time period required for inflating the bag and the crate's ascent could result in the crate surfacing many miles from the surface ship.

It will therefor be appreciated that there has been a significant need for an apparatus and method for the delivery, loading and retrieval of containers from the ocean floor which is technically and economically feasible. Ideally, such an apparatus and method should include an independent lifting means that does not require inflation while on the ocean floor, and should provide for safe, rapid and controlled ascent of containers once filled with material. The present invention fulfills this need, and further provides other related advantages.

SUMMARY OF THE INVENTION

The present invention resides in an apparatus and related method for deep sea mining which make mining the vast wealth of the oceans feasible. Basically, and in general terms, the invention utilizes containers, buoyant bodies used as independent lifting means, means for delivering the containers and buoyant bodies to the ocean floor, and means for transferring the buoyant bodies to the containers. The invention further includes an underwater collection means for gathering material from the ocean floor and means for depositing the material into the containers.

More specifically, in the presently preferred embodiments of the invention, the delivery means for the buoyant bodies comprises a receptacle for holding the buoyant bodies, with the receptacle being composed of a sufficient quantity of dense material to cause it to overcome the buoyancy of the bodies and sink to the ocean floor. The receptacle is guided by cables, extending between the apparatus and the ocean surface, to which the receptacle is releasably and slidably attached. In one embodiment of the invention, the buoyant bodies are substantially spherical in shape and composed of either a solid, buoyant material or filled with a gaseous substance, and the receptacle is tubular in shape and composed of concrete. In another embodiment, the buoyant bodies are comprised of an envelope containing a plurality of buoyant objects. In both embodiments, hollow ceramic spheres may be utilized.

The containers of the invention have a repository for holding the material gathered from the ocean floor, and an attached lid, convexed in shape, for receiving and holding a buoyant body. The buoyancy of the body causes the container and its contents to float to the ocean surface, guided by a cable extending between the apparatus and the ocean surface.

The containers are delivered to the ocean floor in a dispensing rack, which is also releasably and slidably attached to the cables used to guide the receptacle. The rack and receptacle are discarded on the ocean floor when empty of containers and buoyant bodies, respectively.

To prohibit escape of the buoyant bodies from the receptacle during descent, a gate is positioned over an opening in the receptacle from which the buoyant bodies are removed, and the gate is opened when the receptacle arrives at the ocean floor. To facilitate removal of the buoyant bodies from the receptacle opening, the receptacle is oriented with the opening elevated relative to the buoyant bodies to permit the buoyancy of the bodies to effect their removal. The means for transferring the buoyant bodies from the receptacle to the containers include a turnstile having a plurality of rotatably mounted pairs of coplanar, parallel arms which carry the bodies from the receptacle to the containers.

The invention further includes means for positioning the containers for the deposit of gathered material into their repository, and for closing the lid of the container in preparation for receiving a buoyant body and ascent to the ocean surface. The means include an endless belt conveyor.

A method also provided for the delivery, loading and retrieval of the containers used in raising the gathered material from the ocean floor by the steps of delivery of a container to the ocean floor, loading of the container, delivery of a buoyant body to the container and floating the container to the ocean surface under the buoyancy of the buoyant body.

Other features and advantages of the invention will become apparent from the following detailed description, taken in conjunction with the accompanying drawings.

DETAILED DESCRIPTION

Figure 1:
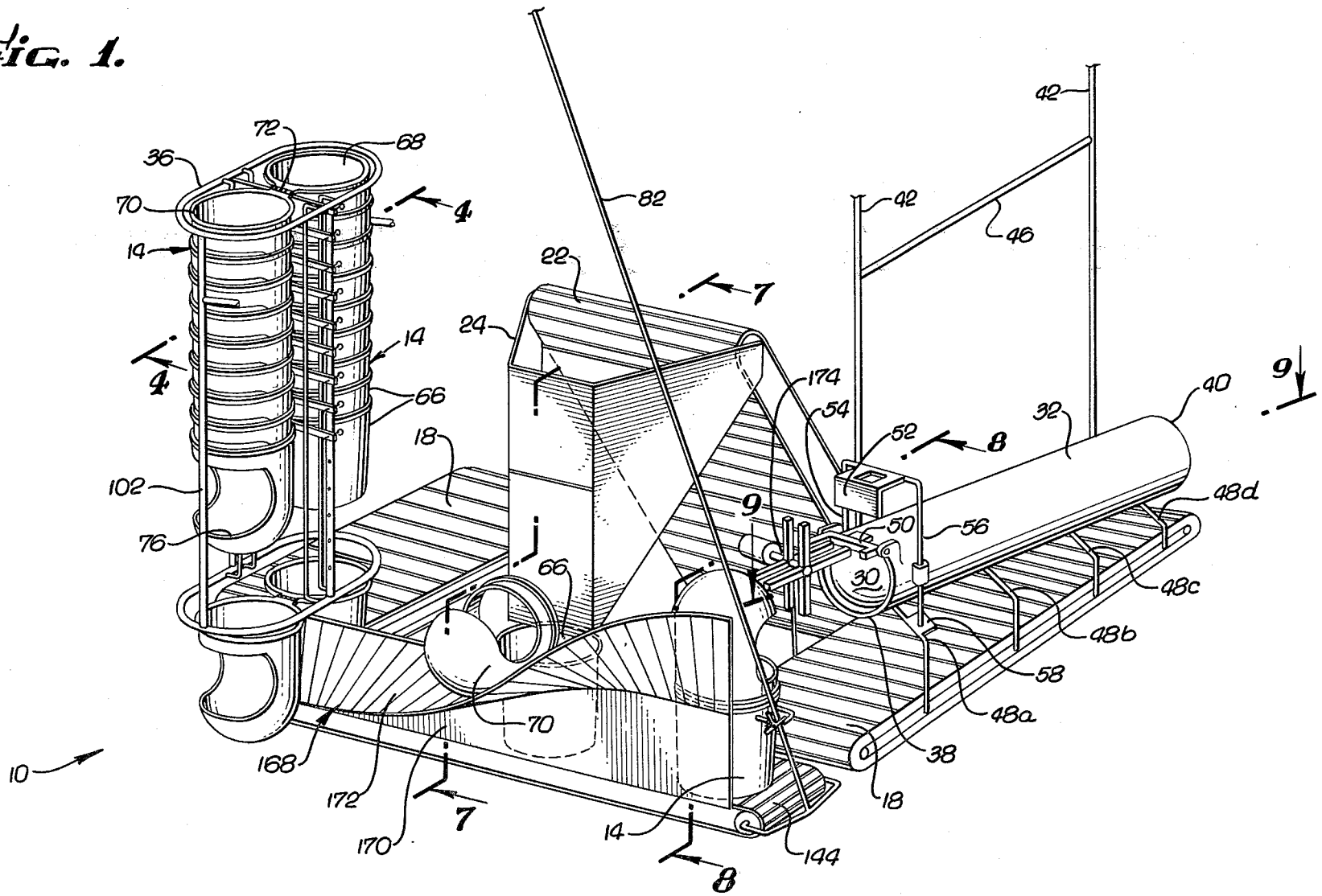
FIG. 1 is a fragmentary, perspective view of a deep sea mining apparatus embodying the present invention.

As shown in the drawings for purposes of illustration, the present invention is embodied in a deep sea mining apparatus, indicated generally by reference numeral 10. The apparatus 10 includes a remotely controlled underwater collection vehicle, indicated generally by reference numeral 12, for traveling along the ocean floor and gathering mineral nodules 13 and for loading the gathered nodules into containers 14 which are recovered by a surface ship (not shown). The vehicle 12 includes a frame 16 which is supported on two sides by two motorized endless belts 18 for locomotion, and a collection head 20 for picking up the nodules 13 from the sea bed. Such collection means are well known in the art, and can be of the type described in U.S. Pat. Nos. 3,305,950; 3,776,593 or 4,010,560, or of any other suitable type. When gathered, the nodules 13 are placed on an inclined, endless moving belt conveyor 22 for transport to and dumping into a hopper 24 having a port 26 located at the lower extremity of the hopper. A slidable control door 28 covers the port 26 to govern the gravity flow of the nodules 13 through the port.

In accordance with the invention, the deep sea mining apparatus 10 and a method for its operation is provided with a plurality of buoyant bodies 30, a discardable receptacle 32 for carrying the buoyant bodies which is composed of a sufficient quantity of dense material to cause the receptacle and contained buoyant bodies to sink to the ocean floor, a plurality of containers 14 for holding the gathered nodules 13 and receiving the buoyant bodies, and a transfer mechanism 34 for transferring the buoyant bodies from the receptacle to the containers. The apparatus provides for the safe, rapid and controlled ascent of the nodule filled containers to the ocean surface using an independent lifting means that does not require inflation while on the ocean floor, or use of safety valves to prevent rupture during ascent. In accordance with another aspect of the invention, the containers 14 are delivered to the ocean floor in a discardable rack 36 which dispenses the containers individually.

As illustrated in FIG. 1, the receptacle 32 is tubular in shape and of sufficient length to hold several buoyant bodies 30, and has a first distal end 38 and a second distal end 40. The buoyant bodies 30 are loaded and removed seriatim from the first distal end 38 of the receptacle 32. In order for the receptacle 32 to sink to the ocean floor when loaded with the buoyant bodies 30, its radial walls are composed of a material, such as concrete, which is dense but yet inexpensive. Since, as will be described in more detail subsequently, the receptacle 32 is discarded once all buoyant bodies 30 are removed, for economical operation the cost of the receptacle must be far less than the value of the nodules 13 recovered using the buoyant bodies the receptacle carried. By using concrete to construct the receptacle 32, it is anticipated that the value of the metals refined from the nodules 13 brought to the surface will be far more than necessary to offset for the cost of the receptacle.

The receptacle 32, full of the buoyant bodies 30, is guided as it sinks to the ocean floor by a pair of cables 42 extending between the ocean surface and the underwater collection vehicles 12. The receptacle 32 is releasably and slidably attached to the cables 42 by a receptacle retainer bar 44 which loosely encircles the cables. To reduce entanglement of the cables 42, spaced along the length of the cables are rigid separation bars 46 which extend between the cables and are attached thereto. A control and power cable (not shown) for controlling and powering the sea mining apparatus 10 may be strung between the cables 42 and secured to the separation bars 46 for support.

The cables 42 guide the receptacle 32 to a plurality of inclined support members 48*a–d* extending upwardly from the vehicle 12 for supporting the receptacle. The inclined support members 48*a–d* are rigidly attached to the vehicle 12 and spaced along one of its sides, directly over one of the endless belts 18, and are downwardly inclined away from the vehicles 12 to permit the receptacle 32 to roll off and to the side of the vehicle when released and discarded. Upon reaching the ocean floor, the receptacle 32 comes to rest on the support members 48*a–d*, with the retainer bar 44 being used to keep the receptacle from rolling off the support members.

The support members 48*a–d* are of varying height and arranged so that when the receptacle 32 rests on the support members its first distal end 38, the end from which the buoyant bodies are removed, is elevated, allowing the buoyancy of the bodies to effect their removal from the receptacle. The support member 48*a* has the greatest height and is positioned adjacent the first distal end 38 of the receptacle 32, with each next adjacent support member 48*b–d* being of diminished height.

Figure 11:
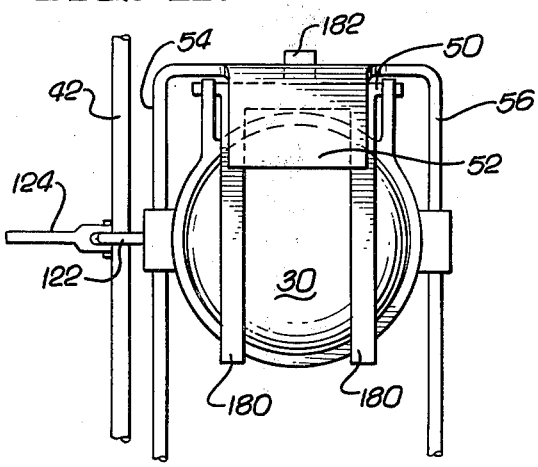
FIG. 11 is a sectional view taken substantially along the lines 11—11 of FIG. 10.

To prevent the buoyant bodies 30 from escaping from the receptacle 32 during descent, a movable gate 50 blocks the first distal end 38 of the receptacle, and fixed bars (not shown) block its second distal end 40. The gate 50 is pivotally attached to the receptacle 32 adjacent to and above its first distal end 38, to permit loading of the receptacle with buoyant bodies 30 at the ocean surface, and removal of the bodies at the ocean floor. As illustrated in FIG. 11, the gate 50 is held in a closed position, blocking the first distal end 38 of the receptacle 32, during descent by a movable lock plate 52 positioned adjacent the gate to inhibit its pivotal movement into an open position. The lock plate 52 is carried by a pair of support arms 54 and 56 slidable attached to the receptacle 32, with support arm 56 extending below the receptacle. As the receptacle 32 completes its descent to the ocean floor and comes to rest on the support members 48*a–d*, the support arm 56 contacts a fixed lift pad 58 attached to support member 48*a* which moves the support arm upwardly relative to the receptacle, raising the lock plate 52 clear of the gate 50 and allowing the gate to pivot into an open position.

The buoyant bodies 30 are spherical in shape, and may be solid and composed of a buoyant material such as cork, or may be hollow with thin, fluid-tight walls and filled, while at the ocean surface, with a gaseous substance such as air. To withstand the pressures encountered at great depth, the buoyant bodies 30 may be constructed of hollow ceramic spheres, well known in the art of deep sea work.

Figure 9:
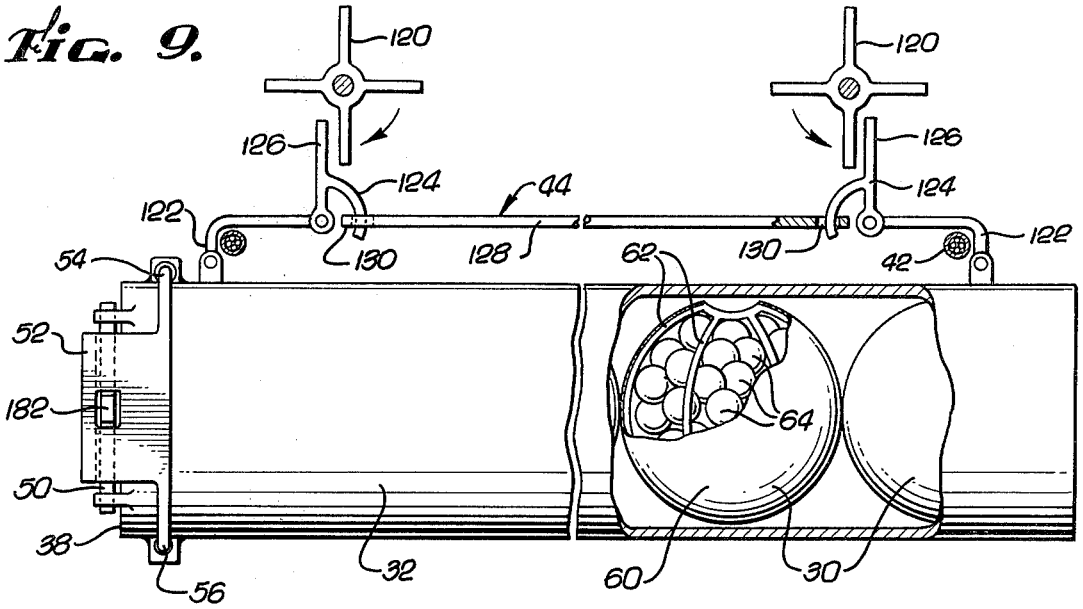
FIG. 9 is an enlarged, fragmentary view of the delivery means shown in FIG. 1, showing an alternative embodiment of the buoyant body.

In an alternative embodiment of the buoyant bodies 30 illustrated in FIG. 9, the bodies are comprised of a spherical envelope 60 made of a flexible skin and supported internally by a plurality of rigid, circumferentially disposed ribs 62, and a plurality of smaller buoyant objects 64 contained within the envelope.

Figure 4:
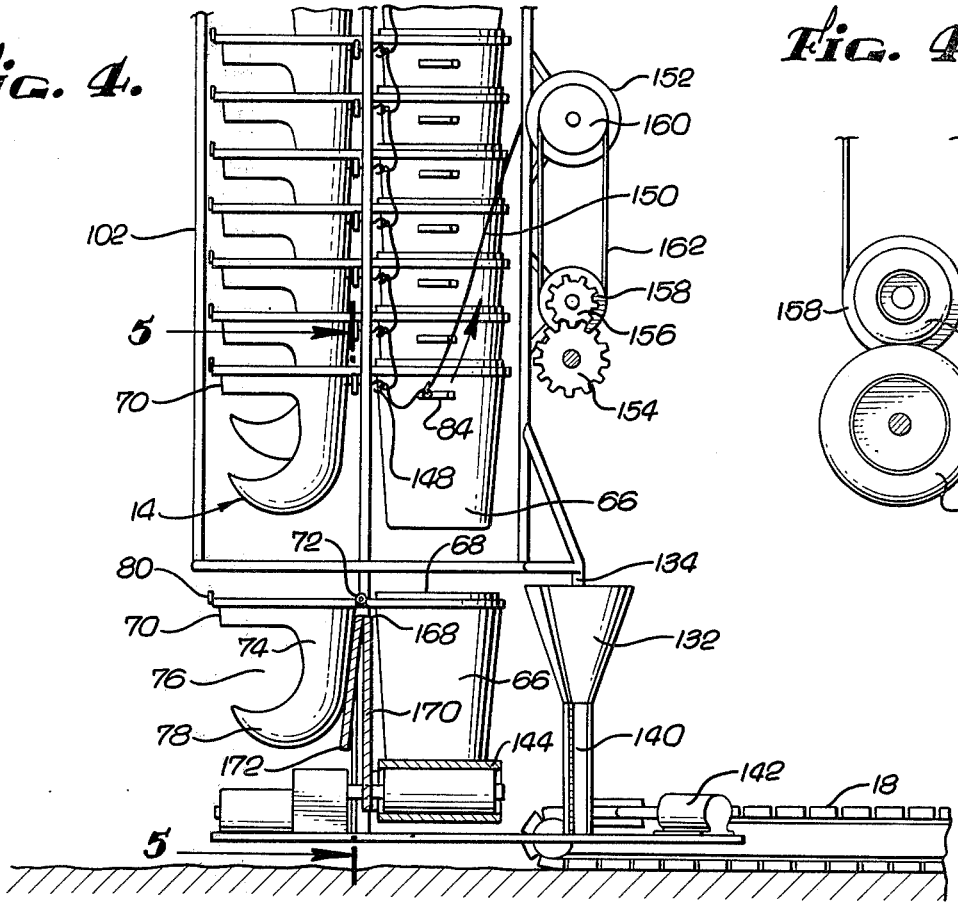
FIG. 4 is a fragmentary, sectional view taken substantially along the lines 4—4 of FIG. 1, showing the container cage of the apparatus.
Figure 8:
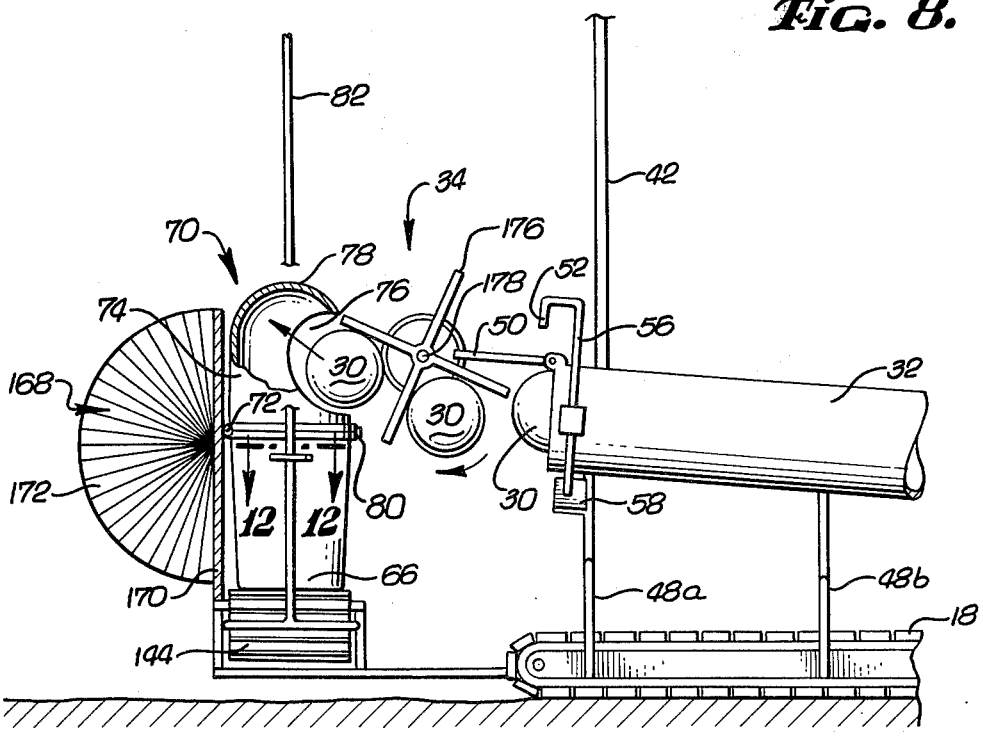
FIG. 8 is a fragmentary, sectional view taken substantially along the lines 8—8 of FIG. 1, showing a container receiving a buoyant body.

As illustrated in FIGS. 1 and 4, the containers 14 have a frustum-shaped repository 66 with an open end 68 for receiving and holding the nodules 13, and a convex lid, indicated generally by reference numberal 70, pivotally mounted to the repository adjacent its open end 68 by a hinge 72. The lid 70 has a body section 74 provided with an aperture 76 sized to admit buoyant bodies 30, and has a dome section 78 with an internal curvature and size sufficient to partially encompass and hold one of the buoyant bodies. When the lid 70 is in a closed position, as illustrated in FIG. 8, the lid is secured to the repository 66 by a snap latch 80, and the container is in a condition to receive one of the buoyant bodies 30 and for ascent to the ocean surface where it is recovered by the surface ship (not shown).

Figure 12:
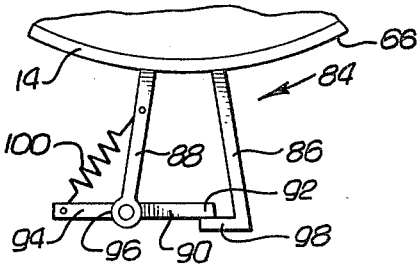
FIG. 12 is an enlarged, fragmentary, sectional view taken substantially along the lines 12—12 of FIG. 8.

The ascent of the container 14 is guided by a single cable 82 extending between the ocean surface and the underwater collection vehicle 12. The container 14 is releasably and sidably attached to the cable 82 by a spring loaded clip 84. The clip 84, as illustrated in FIG. 12, has two adjacent coplanar posts 86 and 88 projecting radially outward from the side of the repository 66. A lever 90, having first and second logitudinal ends, 92 and 94, respectively, and a midsection 96 extending between the ends, is pivotally mounted at its midsection to the radial end of post 88, to pivot in the plane defined by posts 86 and 88. The post 86 has a stop member 98 rigidly fixed to its radial end to inhibit the outward pivotal movement of the first end of the lever 90. A coil spring 100 is attached between the second end of the lever 90 and the post 88, to urge the first end of the lever against the stop member.

Figure 3:
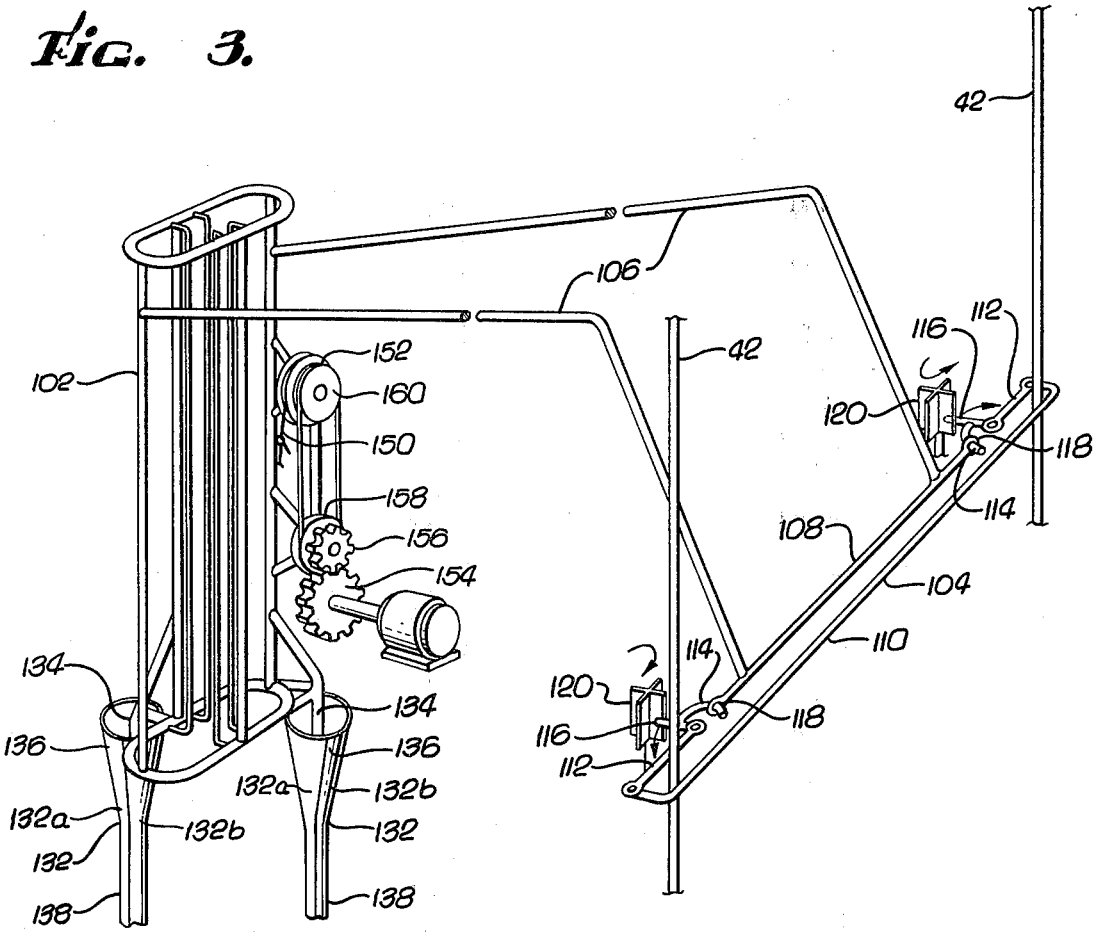
FIG. 3 is a reduced scale, perspective view of the container cage of the apparatus shown in FIG. 1, without containers.

The containers 14 are delivered to the ocean floor by a rack 102 which holds a vertical stack of open containers 14, with the lid 70 and repository 66 of one container fitting within the lid and repository of the next, respectively. The rack 102 is guided as it sinks to the ocean floor by the pair of cables 42. As illustrated in FIG. 3, the rack 102 is releasably and slidably attached to the cables 42 by a rack retainer bar 104 which is supported by two extension arms 106 projecting from the rack. The extending arms 106 have a cross bar 108 extending between their distant ends, and the rack retainer bar 104, in combination with the cross bar, loosely encircles the cables 42.

To provide for release of the rack 102 from the cables 42, the rack retainer bar 104 is comprised of a C-shaped member 110, two straight hinged links 112, and two hooks 114 with rigidly attached, projecting studs 116. The links 112 are pivotally connected at one end to an end of the C-shaped member 110, and at the other end to the hooks 114. The cross bar 108 has at each of its distal ends eyes 118 which are engagable with the hooks 114. To release the rack 102 from the cables 42, the hooks 114 are disengaged from the eyes 118 by a pair motorized blade rotors 120 which, upon actuation, contact and move the studs 116, withdrawing the hooks from the eyes and letting the rack retainer bar 104 fall away.

The receptacle 32 is released from the cables 42 for discarding in the same manner. As illustrated in FIG. 9, the receptacle container bar 44, which attaches the receptacle 32 to the cables 42, is comprised of two L-shaped members 122, two hooks 124 with rigidly attached, projecting studs 126, and a straight bar member 128 with eyes 130 at each of its distal ends for engagement with the hooks. The L-shaped members 122 are pivotally connected at one end to the receptacle 32, and at the other end to the hooks 124. To release the receptacle 32 from the cables 42, the hooks 124 are disengaged from the eyes 130 by the motorized blade rotors 120 which, upon actuation, contact and move the studs 126, withdrawing the hooks from the eyes and letting the straight bar member 128 fall away and the receptacle roll off and to the side of the vehicle 12.

The cables 42 guide the rack 102 to two funnel-shaped leg supports 132, extending upwardly from the vehicle 12, which engage and support a pair of rack legs 134 extending below the rack. The leg supports 132 have inverted conical mouth sections 136 which are wide enough to catch the rack legs 134 as the rack 82 approached the ocean floor, and have narrow throat sections 138 mounted below the mouth sections to hold the rack legs and rack in an upright attitude once in place on the vehicle 12. The mouth sections 136 of the leg supports 132 direct the rack legs 134 into the throat sections 138.

Figure 2:
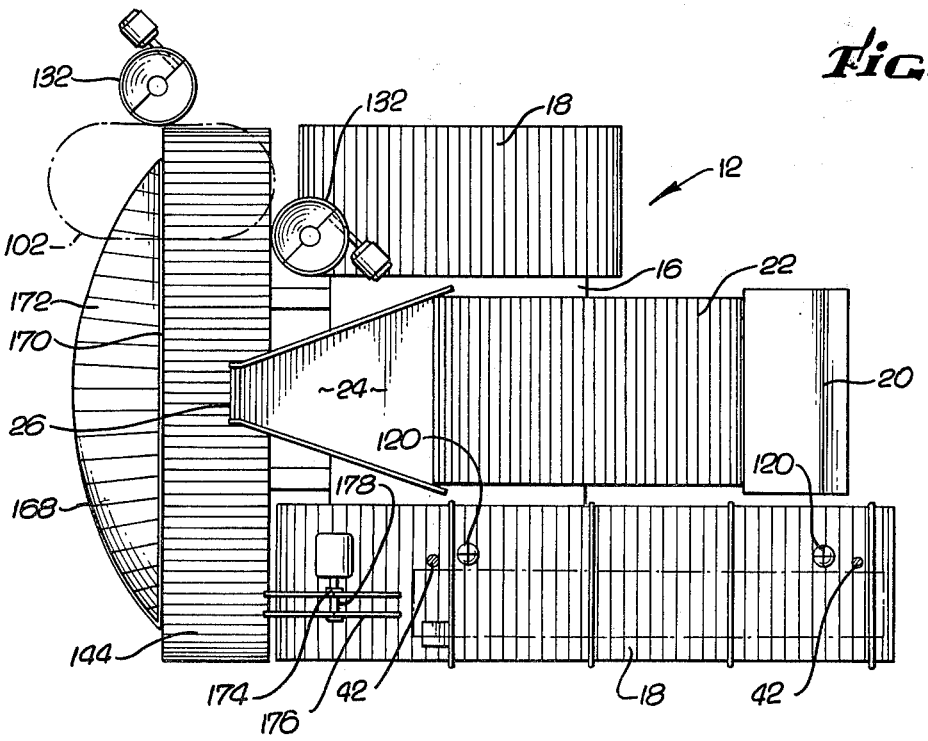
FIG. 2 is an enlarged, top view of the apparatus shown in FIG. 1.
Figure 5:
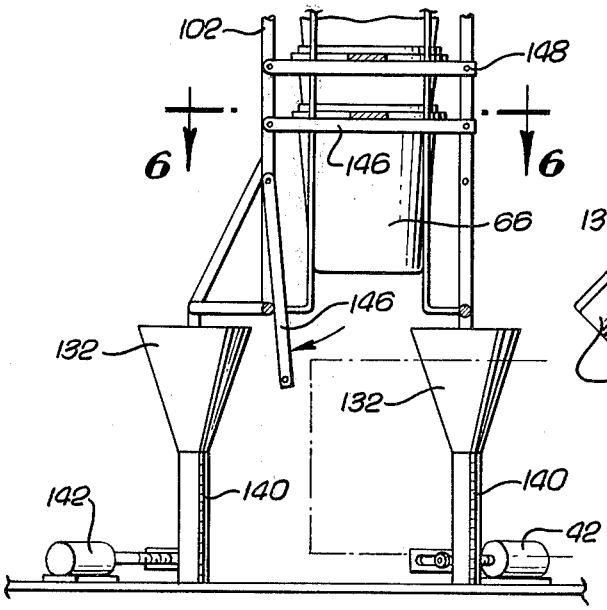
FIG. 5 is a fragmentary, sectional view taken substantially along the lines 5—5 of FIG. 4.
Figure 6:
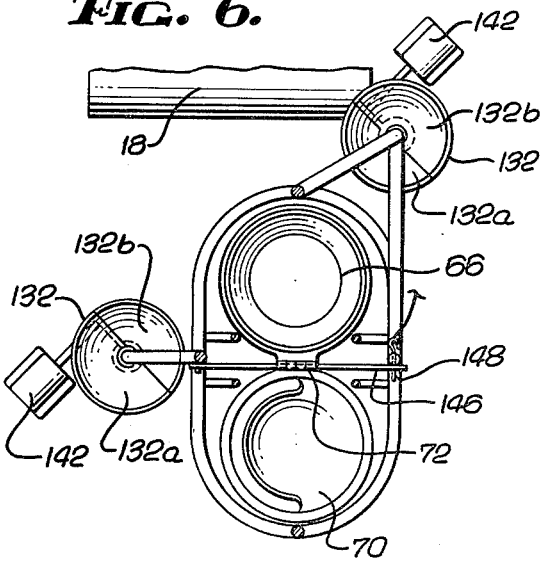
FIG. 6 is a fragmentary, sectional view taken substantially along the lines of 6—6 of FIG. 5.
Figure 7:
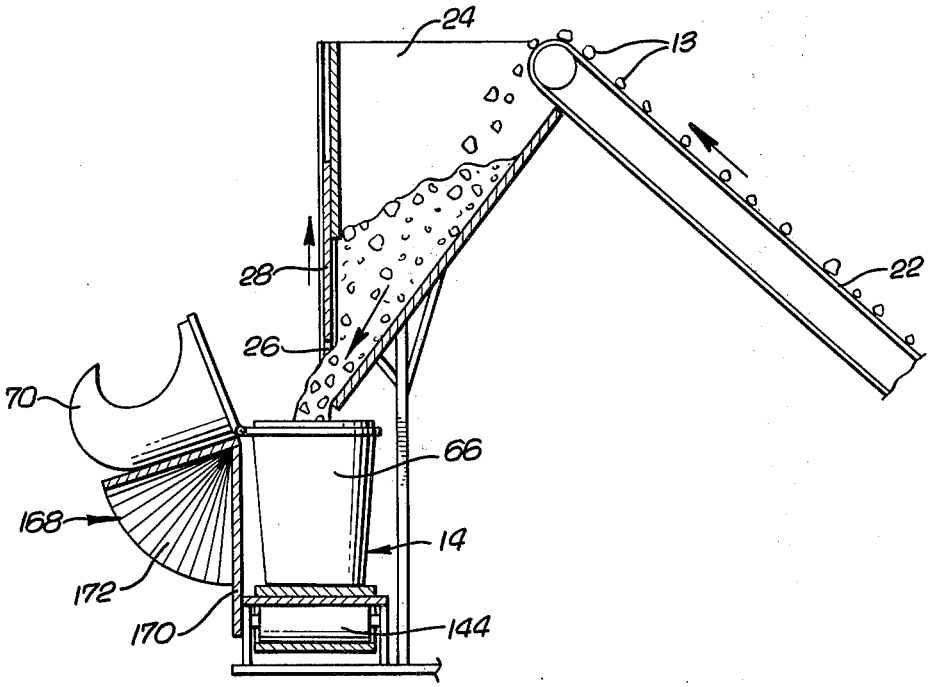
FIG. 7 is a fragmentary, sectional view taken substantially along the lines 7—7 of FIG. 1, showing a container being loaded.

The leg supports 132 are made up of mating longitudinal half-body portions 132*a* and 132*b*, each portion being pivotally connected to the other along an adjacent longitudinal edge 140 positioned closest the vehicle 12. When the rack 102 is empty of containers 14, it is discarded and another rack full of containers is delivered to take its place. To discard the rack, a motor driven screw 142 (see FIGS. 2, 5 and 6) engages the half body portions 132*a* and 132*b* of each of the leg supports 132, and opens the half body portions with respect to each other, allowing the rack 102 to fall away and to the side of the vehicle 12.

Once delivered to the ocean floor, the rack 102 dispenses the stacked, open containers 14 individually and drops them onto a motorized endless belt conveyor 144. The containers 14 are retained in place in the rack 102 until dispensed by drop rods 146 which are pivotally attached at one end to the rack, and releasably connected at their other end to the rack by removable pins 148. One of the drop rods 146 extends under the hinge 72 of each of the containers 14, and the containers are sequentially dispensed by removing the pins 148 and dropping the drop rods 146, starting at the bottom of the rack 102.

As illustrated in FIGS. 3 and 4, to sequentially remove the pins 148, the pins are rigidly attached, at spaced intervals, to a flexible line 150, and one end of the line is attached to a hub of a rotatable spool 152 which, when rotated, reels the line in and pulls the pins. Rotation of the spool 152 is controlled by a motorized gear 154 which is mounted on the vehicle 12 and which engages a mating gear 156 rotatably mounted on the rack 102. A pair of pulleys 158 and 160 are rigidly and coaxially fixed to the mating gear 156 and the spool 152, respectively, and the pulleys are interconnected by a drive belt 162 which transmits the rotational force of the motorized gear 154 to the spool.

Figure 4A:
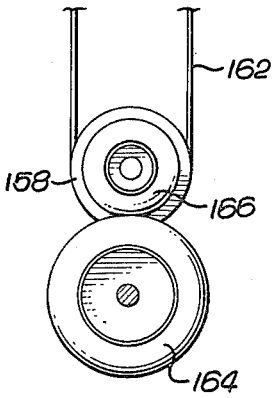
FIG. 4A is a fragmentary side elevational view of an alternative embodiment of the gear arrangement shown in FIG. 4.

An alternative to the motorized gear 154 and mating gear 156 embodiment is illustrated in FIG. 4A, and comprises a motorized wheel 164, coated with a non-slip material, that contacts and frictionally drives a mating wheel 166 rotatably mounted on the rack 102, thus avoiding any difficulty with the meshing of gear teeth. The pulley 158 is rigidly and coaxially fixed to the mating wheel 166, and interconnected with the pulley 160 by the drive belt 162.

The containers 14 are dispensed from the rack 102 onto the conveyor 144 in the open position with the repository 66 on one side of a wall 168 and the lid 70 on the other side. The wall 168 parallels the conveyor 144, and is comprised of a vertically disposed lower wall section 170, having attached along its upper longitudinal edge and on the side of the wall toward the lid 70, an upper wall section 172 angularly disposed relative to the lower wall section. The upper wall section 172 is in a parallel and side-by-side relation with the lower wall section 170 adjacent the rack 102, and as the upper wall section extends along the length of the lower wall section, its angular disposition varies helically, in a counterclockwise direction, relative to the lower wall section.

The conveyor 144 carries the dispensed containers 14 under the port 26 of the hopper 24 for loading of the nodules 13 into the repository 66 of the containers, and then carries the containers to a position adjacent to the first distal end 38 of the receptacle 32, from which the buoyant bodies 30 are removed. In this position the self-locking clip 84 of the containers 14 engages the container cable 82, and one of the buoyant bodies 30 is transferred to the convex lid 70 of the container. As the containers 14 travel along on the conveyor 144, the upper wall section 17 frictionally engages the lid 70 and gradually closes it, causing the snap latch 80 to lock.

The transfer mechanism 34 for transferring the buoyant bodies 30 from the recepacle 32 to the containers 14 comprises a motorized turnstile 174 positioned adjacent the first distal end 38 of the receptacle 32 to receive the buoyant bodies 30 when they exit the receptacle, and to carry and transfer the buoyant bodies to the convex lid 70 of the containers 14. The turnstile 174 has a plurality of pairs of coplanar, parallel arms 176 radially extending from and rotatably mounted on a hub 178. Each of the pairs of arms is sufficiently spaced to carry the buoyant bodies without the bodies passing between the pairs of arms as the turnstile 174 rotates.

Figure 10:
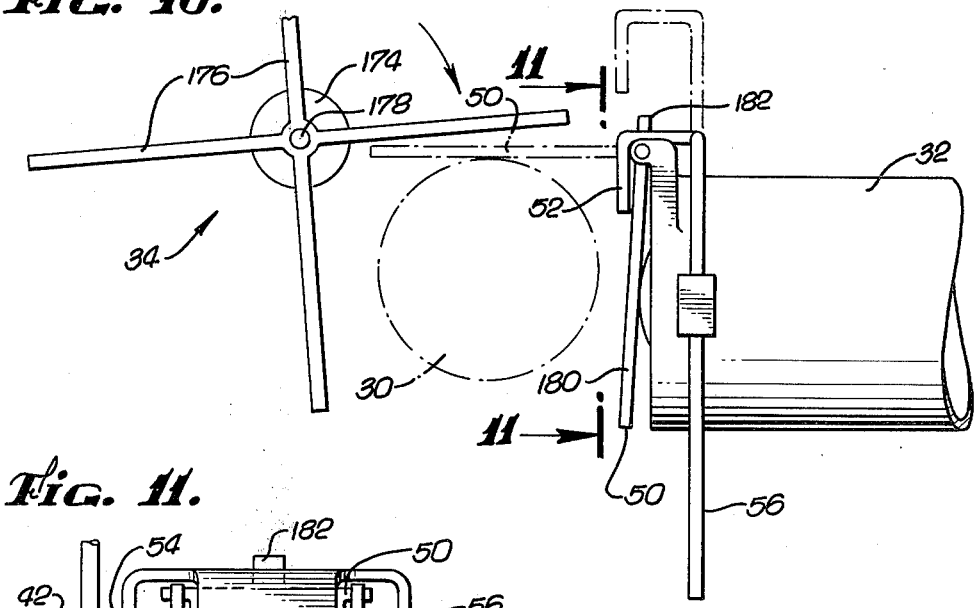
FIG. 10 is an enlarged, fragmentary view of the turnstile shown in FIG. 8.

To provide a smooth transition of the buoyant bodies 30 over the space between the receptacle 32 and the turnstile 174, as illustrated in FIG. 10, the movable gate 50 includes two parallel bars 180, in a U-shaped configuration, which are spaced close enough together to pass between the pairs of arms 176 of the turnstile without interference when pivoted into an open position, and far enough apart to guide the buoyant bodies from the receptacle and into the turnstile. The bars 180 of the gate 50 pivot freely under the upward force exerted upon them by the buoyant bodies 30 as they exit the receptacle, with the travel of the bars upwardly being limited by a stop tab 182 which is attached to the bars and extends in a direction opposite the bars, and which is positioned to contact the receptacle and stop the upward movement of the bars when the bars are in longitudinal alignment with the receptacle.

As illustrated in FIG. 8, the buoyant bodies 30 enter the turnstile 174 and the turnstile is rotated, carrying the bodies, until the buoyancy of the bodies causes them to leave the arms 176 of the turnstile and float into the aperture 76 in the convex lid 70 of the containers 14. The ascent of the containers 14 commences immediately upon receipt of and under the buoyant force of the buoyant bodies 30, with the ascent being guided by the cable 82, as previously discussed. Upon reaching the surface, the containers 14 are recovered by a surface ship and emptied, and loaded in another rack 102 for reuse.

From the foregoing, it will be appreciated that the invention, as described herein for purposes of illustration, provides a deep sea mining apparatus and method for the safe, rapid and controlled delivery, loading and retrieval of containers from the ocean floor using independent lifting means which are delivered to the ocean floor in a buoyant state and transferred to the containers to effect their ascent. It will also be appreciated that, although specific enbodiments of the invention have been described herein for purposes of illustration, various modifications may be made without departing from the spirit and scope of the invention. Accordingly, the invention is not to be limited except as by the appended claims.

I claim:

1. A deep sea mining apparatus comprising:

an underwater collection device for gathering material from the ocean floor;

at least one substantially spherical buoyant body;

at least one container, said container including a repository for holding said material and a convex lid for receiving said buoyant body;

means for delivering said container to the ocean floor and dispensing said container;

loading means for depositing said material into said container;

a receptable for delivering said buoyant body to the ocean floor, said receptacle having sufficient density to cause said receptacle holding said buoyant body to sink to the ocean floor;

transfer means for transferring said buoyant body to said container, for ascent of said container and its contents to the ocean surface under the buoyancy of said buoyant body;

means for controlling the ascent of said containers; and means for discarding said delivering and dispensing means; and for discarding said receptacle.

2. A deep sea mining apparatus comprising:

an underwater collection device for gathering material from the ocean floor;

at least one buoyant body;

at least one container, said container including a repository for holding said material and means for receiving said buoyant body;

loading means for depositing said material into said repository of said container;

delivery means for delivering said buoyant body to the ocean floor, said delivery means including a receptacle for holding said buoyant body, said receptacle having sufficient density to cause said receptacle holding said buoyant body to sink to the ocean floor; and transfer means for transferring said buoyant body to said container, whereby the buoyancy of said body carries said container and its contents to the ocean surface.

3. The apparatus of claim 2, wherein said receptacle is composed of a dense material.

4. The apparatus of claim 2, wherein said receptacle is substantially tubular in shape and of sufficient length to hold a plurality of said buoyant bodies.

5. The apparatus of claim 2, wherein said buoyant body is a hollow convex body having fluid-tight walls.

6. The apparatus of claim 2, wherein said buoyant body is composed of a substantially solid, buoyant material.

7. The apparatus of claim 2, wherein said transfer means include a turnstile for carrying said buoyant body from said receptacle to said means for receiving said buoyant body.

8. The apparatus of claim 2, wherein said deep sea mining apparatus further includes means for delivering a plurality of said containers to the ocean floor and dispensing said containers, said means including a container rack.

9. The apparatus of claim 8, wherein said deep sea mining apparatus further includes means for discarding said receptacle and said container rack.

10. A deep sea mining apparatus comprising:

an underwater collection device for gathering material from the ocean floor;

at least one buoyant body;

at least one container for holding said material and receiving said buoyant body;

loading means for depositing said material into said container;

delivery means for delivering said buoyant body to the ocean floor, said means including a receptacle for holding said buoyant body, said receptable being individually deliverable to the ocean floor; and transfer means for transferring said buoyant body to said container, whereby the buoyancy of said body carries said container and its contents to the ocean surface.

11. The apparatus of claim 10, wherein said buoyant body is a hollow convex body having fluid-tight walls.

12. The apparatus of claim 11, wherein said buoyant body is composed of ceramic and filled with a gaseous substance.

13. The apparatus of claim 10, wherein said buoyant body is composed of a substantially solid, buoyant material.

14. The apparatus of claims 11 or 13, wherein said buoyant body is substantially spherical in shape.

15. The apparatus of claim 10, wherein said buoyant body includes an envelope containing a plurality of buoyant objects.

16. The apparatus of claim 15, wherein said envelope has flexible skin and a plurality of rigid reinforcing ribs.

17. The apparatus of claim 16, wherein said buoyant objects are hollow convex bodies having fluid-tight walls.

18. The apparatus of claim 10, wherein said container includes a repository for holding said material and a receiving means for receiving said buoyant body.

19. The apparatus of claim 18, wherein said receiving means include a convex lid mounted on said repository, said lid having a dome section and a body section, said body section having an aperture sized to admit said buoyant body.

20. The apparatus of claim 19, wherein said deep sea mining apparatus further includes means for positioning said container for the deposit of said material into said repository with said convex lid open, and for closing said convex lid when said material has been deposited in preparation for ascent to the ocean surface.

21. The apparatus of claim 20, wherein said means for positioning and closing include an endless belt conveyor for carrying said container.

22. The apparatus of claim 10, wherein said deep sea mining apparatus further includes control means for controlling the ascent of said containers to the ocean surface.

23. The apparatus of claim 22, wherein said control means include a cable extending between the ocean surface and said underwater collection device, and said container is releasably and slidably attached to said cable.

24. The apparatus of claim 10, wherein said deep sea mining apparatus further includes means for separately delivering a plurality of said containers to the ocean floor and individually dispensing said containers.

25. The apparatus of claim 24, wherein said means for delivering said dispensing include at least one cable extending between the ocean surface and said underwater collection device, and a rack for holding said containers during their delivery to the ocean floor and individually dispensing said containers, said rack being releasably and slidably attached to said cable.

26. The apparatus of claim 25, wherein said deep sea mining apparatus further includes means for discarding said rack.

27. The apparatus of claim 10, wherein said deep sea mining apparatus further includes means for discarding said receptacle.

28. The apparatus of claim 10, wherein said receptacle is substantially tubular in shape and of sufficient length to hold a plurality of said buoyant bodies.

29. The apparatus of claim 28, wherein the radial walls of said receptacle are composed of concrete to cause said receptacle holding said buoyant bodies to sink to the ocean floor.

30. The apparatus of claim 10, wherein said delivery means further include means for guiding said receptacle to the ocean floor.

31. The apparatus of claim 30, wherein said means for guiding said receptacle include at least one cable extending between the ocean surface and said underwater collection device, and said receptacle is releasably and slidably attached to said cable.

32. The apparatus of claim 31, wherein said means for guiding said receptacle include two cables having a plurality of rigid bars attached to and extending between said cables, said bars being spaced along the length of said cables for maintaining said cables at a preselected separation.

33. The apparatus of claim 10, wherein said receptacle has an opening through which said buoyant body is removed, and said transfer means include a turnstile positioned adjacent said opening to receive said buoyant body when removed from said receptacle and to carry said buoyant body to said container, said turnstile having a plurality of rotatably mounted pairs of substantially coplanar, parallel arms, each of said pairs of arms being sufficiently spaced to carry said buoyant body without said body passing between said arms.

34. The apparatus of claim 10, wherein said receptacle has an opening through which said buoyant body is removed, and further includes gate means positioned over said opening to prohibit removal of said buoyant body while said receptacle is in transit to the ocean floor.

35. The apparatus of claim 34, wherein said transfer means include means for orienting said receptacle with said opening elevated relative to said buoyant body, and means for activating said gate means to permit removal of said buoyant body, whereby the buoyancy of said body causes the body to exit the receptacle.

36. A deep sea mining apparatus comprising:

an underwater collection device for gathering material from the ocean floor;

at least one buoyant body;

at least one container for holding said material and receiving said buoyant body;

loading means for depositing said material into said container;

delivery means for delivering said buoyant body to the ocean floor, said delivery means including a receptacle for holding said buoyant body, said receptacle being composed of a sufficient quantity of dense material to cause said receptacle holding said buoyant body to sink to the ocean floor; and transfer means for transferring said buoyant body to said container, whereby the buoyancy of said body carries said container and its contents to the ocean surface.

37. The apparatus of claim 36, wherein said deep sea mining apparatus further includes means for discarding said receptacle.

38. The apparatus of claim 36, wherein said receptacle is substantially tubular in shape and of sufficient length to hold a plurality of said buoyant bodies.

39. The apparatus of claim 38, wherein the radial walls of said receptacle are composed of concrete.

40. The apparatus of claim 36, wherein said delivery means further include means for guiding said receptacle as it sinks to the ocean floor.

41. The apparatus of claim 40, wherein said means for guiding said receptacle include at least one cable extending between the ocean surface and said underwater collection device, and said receptacle is releasably and slidably attached to said cable.

42. The apparatus of claim 41, wherein said means for guiding said receptacle include two cables having a plurality of rigid bars attached to and extending between said cables; said bars being spaced along the length of said cables for maintaining said cables at a preselected separation.

43. The apparatus of claim 36, wherein said receptacle has an opening through which said buoyant body is removed, and said transfer means include a turnstile positioned adjacent said opening to receive said buoyant body when removed from said receptacle and to carry said buoyant body to said container, said turnstile having a plurality of rotatably mounted pairs of substantially coplanar, parallel arms, each of said pairs of arms being sufficiently spaced to carry said buoyant body without said body passing between said arms.

44. The apparatus of claim 36, wherein said receptacle has an opening through which said buoyant body is removed, and further includes gate means positioned over said opening to prohibit removal of said buoyant body while said receptacle is in transit to the ocean floor.

45. The apparatus of claim 44, wherein said transfer means include means for orienting said receptacle with said opening elevated relative to said buoyant body, and means for activating said gate means to permit removal of said buoyant body, whereby the buoyancy of said body causes the body to exit the receptacle.

46. A deep sea mining apparatus comprising:

an underwater collection device for gathering material from the ocean floor;

at least one buoyant body;

at least one container for holding said material and receiving said buoyant body, said container having a repository for holding said material and a receiving means for receiving said buoyant body, said receiving means including a lid mounted on said repository;

means for positioning said container for the deposit of said material into said repository with said lid open, and for closing said lid when said material has been deposited in preparation for ascent to the ocean surface;

loading means for depositing said material into said container;

deliver means for delivering said buoyant body to the ocean floor;

transfer means for transferring said buoyant body to said container, whereby the buoyancy of said body carries said container and its contents to the ocean surface.

47. The apparatus of claim 46, wherein said means for positioning and closing include an endless belt conveyor for carrying said container.

48. The apparatus of claim 46, wherein said lid includes a dome section and a body section, said body section having an aperture sized to admit said buoyant body.

* * * * *

UNITED STATES PATENT AND TRADEMARK OFFICE

CERTIFICATE OF CORRECTION

PATENT NO. : 4,336,662

DATED : June 29, 1982

INVENTOR(S) : Dennis L. Baird

It is certified that error appears in the above-identified patent and that said Letters Patent are hereby corrected as shown below:

Claim 25, line 13 delete "said" and insert therefor --and--.

Signed and Sealed this

*Twenty-second* Day of *March 1983*

[SEAL]

*Attest:*

GERALD J. MOSSINGHOFF

*Attesting Officer*

*Commissioner of Patents and Trademarks*